United States Patent [19]

Lipperts

[11] 4,331,850

[45] May 25, 1982

[54] VACUUM SWITCH INCLUDING A GETTER DEVICE

[75] Inventor: Joseph H. F. G. Lipperts, Hengelo, Netherlands

[73] Assignee: Hazemeijer B.V., Hengelo, Netherlands

[21] Appl. No.: 98,631

[22] Filed: Nov. 29, 1979

[30] Foreign Application Priority Data

Dec. 1, 1978 [NL] Netherlands ..... 7811787

[51] Int. Cl.[3] ..... H01H 33/66

[52] U.S. Cl. ..... 200/144 B

[58] Field of Search ..... 200/144 B

[56] References Cited

U.S. PATENT DOCUMENTS

| | | | |
|---|---|---|---|
| 2,813,216 | 11/1957 | Dailey et al. | 200/144 B |
| 3,090,852 | 5/1963 | Greenwood | 200/144 R |
| 3,544,829 | 12/1970 | Someya et al. | 313/178 |

FOREIGN PATENT DOCUMENTS

| | | |
|---|---|---|
| 885763 | 8/1953 | Fed. Rep. of Germany . |
| 900278 | 6/1945 | France . |
| 2204032 | 5/1974 | France . |
| 1005676 | 9/1965 | United Kingdom . |
| 1169730 | 11/1969 | United Kingdom . |

*Primary Examiner*—Robert S. Macon

*Attorney, Agent, or Firm*—Watson, Cole, Grindle & Watson

[57] ABSTRACT

A vacuum switch comprising a vacuum tight envelope accommodating in vacuum contacts mounted on current carrying contact rods and capable of movement with respect to each other as well as a getter device, comprising a getter element provided with a getter material which may absorb optionally present gases upon evaporation thereof by the application of heat generated by an induced current, a metal shield arranged between the getter device and the insulated walls of the vacuum switch, said shield functioning as the surface on which the getter material is deposited and being provided with slots preventing the occurrence of eddy currents in the shield and in that the getter element emits the getter material by evaporation at a single location only, this location and the location of the slots in the shield are situated with respect to each other in such a manner that the contact rod carrying both the getter device and the shield will keep the getter material from emanating beyond said shield.

4 Claims, 7 Drawing Figures

VACUUM SWITCH INCLUDING A GETTER DEVICE

The invention relates to a vacuum switch comprising a vacuum tight envelope accommodating in vacuum contacts mounted on current carrying contact rods and capable of movement with respect to each other as well as a getter device comprising a getter element provided with a getter material which may absorb optionally present gases upon evaporation thereof by the application of heat generated by an induced current. These gases may be given off by parts of the switch but may also penetrate by diffusion into the vacuum tight envelope.

A similar vacuum switch is known from Dutch Patent Specification No. 149,629. The getter material is heated indirectly by means of the current flowing through the switch whereby the absorbtivity of the getter material increases due to the increase of the diffusion velocity. For increasing the adsorbing surface and consequently the absorbtivity, the getter material has been applied on a large number of small metal plates mounted radially next to each other on an iron ring core the plates being regularly distributed along the circumference of the ring core. The ring core has been mounted on one of the contact rods so that when current passes through the contact rods the generated alternating magnetic field is concentrated within the ring core. As a result thereof there are generated electric short circuit currents in the plates encircling the ring core whereby the plates and consequently the getter material are heated.

However, the construction of the getter element is complicated and therefore expensive. Moreover this known gettering method implies the drawback that the adsorption effect of the getter material is also dependent on the current flowing through the vacuum switch.

The above mentioned drawbacks are avoided by the vacuum switch according to the invention which is characterized in that a metal shield has been arranged between the getter element and the insulated walls of the vacuum switch, said shield functioning as the surface on which the getter material is deposited and said shield being provided with slots preventing the occurrence of eddy currents in the shield, and in that the getter element emits the getter material by evaporation at a single location only, this location and the location of the slots in the shield being situated with respect to each other in such a manner that the contact rod carrying both the getter element and the shield will keep the getter material from emanating beyond said shield.

The current through the circular conductor of the getter element may easily by induced by means of a coil positioned outside the switch and generating an alternating field, preferably a high frequency alternating field. An additional advantage hereof is that the contact rod not only serves as the carrier of the contact but also as a screen against the escape of getter material beyond the shield. In the above mentioned known switch indeed the disconnected current presents transient phenomena having higher frequencies above the normal line frequency of 50 cycles but these cannot be influenced externally. By means of a coil positioned outside the switch any desired current may be induced in the getter element.

A shield suitable for use in the vacuum switch according to the invention is preferably in the shape of a cup having an opening in the bottom thereof by means of which the shield may be mounted on the contact rod according to the center line of the cup, which shield is provided with a first gap or slot extending almost entirely along the circumference of the wall of the cup close to the bottom of the cup and parallel thereto but for a short connecting strip by means of which the two parts of the cup separated from each other by the first gap are kept connected to each other as well as with a second gap or slot arranged perpendicularly to said first gap and extending substantially parallel to the center line of the cup through the wall of the cup starting from the point situated at the first gap diametrically opposite to the connecting strip and running to the open end of the shield turned away from the bottom of the cup.

Thanks to both the gaps the shield constitutes almost no hindrance for the inductive coupling between the coil positioned outside the vacuum switch and the getter element, for almost no eddy currents can occur in the shield.

A getter element suitable for use in the vacuum switch according to the present invention consists preferably of an annular body constituting an electrically closed circuit, which body for the major part of its periphery consists of a good electric conductor and for the remaining part of a less good electric conductor on which the getter material is provided. This less good electrically conducting part will preferably consist of a resistance.

The application of a shield on which there is deposited getter material evaporated from the getter element has yet another advantage with respect to the known gettering method disclosed in the above mentioned Dutch Patent Specification. The getter element employed in the vacuum switch according to the above mentioned patent specification will mainly pick up gases by adsorption in the getter material provided on the small plates. When employing the shield in combination with the getter element according to the invention there will also be an absorption of gases due to the deposition of the evaporated getter material onto the shield.

In the vacuum switch according to the present invention there may advantageously be used getter materials having a two stage activity. In the first stage in which the getter material is evaporated the large molecules will be packed in particular. These large molecules will not only be absorbed thereby but also be "burried" within the deposited layer of getter material where upon these large molecules may not diffuse freely anymore into the evacuated space. In the second stage in which the getter material has been deposited as a thin film on the surface of the shield the small molecules still capable of diffusing into the evacuated space will be adsorbed by the deposited film and diffuse into the getter material.

It should be remarked that the inductive heating for evaporating getter material by means of an induction coil is known per se from the U.S. Pat. No. 859,021. This reference however does not concern the absorption of optionally present gases in a vacuum switch but the use of this known device in the final stage of the evacuation of for instance an X-ray tube for removing the last gas residues which cannot be removed anymore by means of a vacuum pump. According to said U.S. Patent Specification the getter material is electrically conductive and consists of a ring in which an electric current and consequently heat is generated by induction by means of an external coil. Around this ring of getter material there has been arranged a shield by means of which the radiant heat of the ring has to be shielded from the surrounding glass envelope of this pumping element. In the absence of this ring the glass of the envelope would become soft. In this instance the shield consists of a keramic or another electrically insulating material. The insulating walls of a vacuum switch however are not suitable to serve as the surface on which the getter material may be deposited because the conductive getter material would cause an appreciable increase of the chance of a break through. The application of a shield of an insulating material like in the afore said U.S. patent specification would increase the manufacturing cost of such a vacuum switch to such a degree that for that reason and not withstanding the above mentioned drawbacks the solution according to the Dutch patent specification No. 149,629 was chosen at first. Due to the extensive heat generation occurring only at the location of the getter device and due to the bad heat conductivity of the keramic material there will be caused for that matter so high mechanical stresses that the shield may easily brake and will be unsuitable for the present purpose. Moreover the fastening of a keramic shield within a vacuum switch will meet large problems.

The present invention will now be elucidated in detail with reference to the drawing in which an embodiment has been shown.

Figure 1:
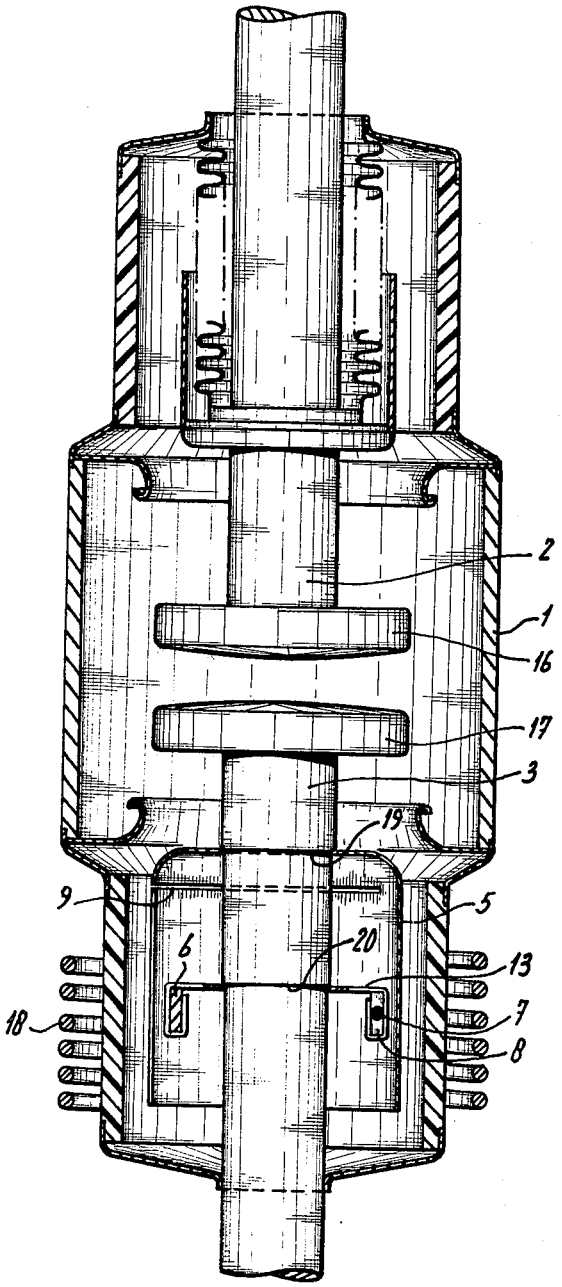
FIG. 1 shows a cross section of a vacuum switch including the gettering means according to the present invention.

With reference to FIG. 1 the reference numeral 1 indicates the vacuum tight envelope in which there have been provided a movable contact 16 on a contact rod 2 and a fixed contact 17 on a fixed contact rod 3.

Apart from the gettering means the embodiment of this vacuum switch may substantially correspond to the one disclosed in the above mentioned Dutch patent specification No. 149,629.

On the fixed contact rod 3 there have been provided a getter element 6 as well as a shield 5 surrounding said getter element 6.

Figure 2:
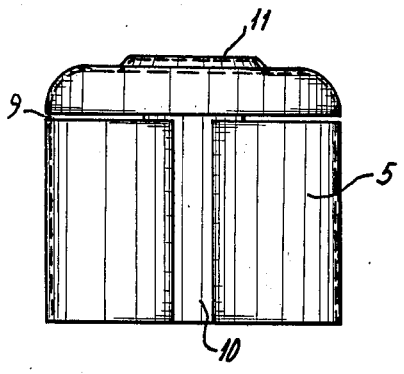
FIG. 2 shows a side elevation of a shield according to the present invention.
Figure 3:
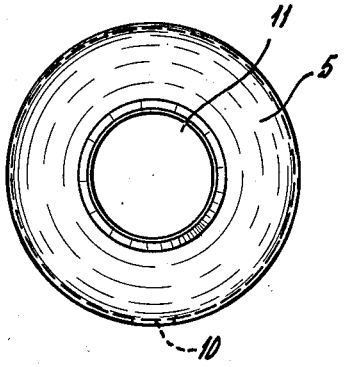
FIG. 3 shows a plan view of the shield according to FIG. 2.

The shield separately represented in FIGS. 2 and 3 is preferably in the shape of a cup and possesses an opening 11 in the bottom thereof by means of which it may be fastened to the contact rod 3 in a suitable way, for instance by soldering. The shield 5 has furthermore been provided with a circular gap 9 and a gap 10 perpendicular to said first gap. The circular gap 9 extends along almost the entire circumference of the cup apart from a short connecting strip and runs parallel to the bottom thereof at a short distance therefrom. The gap 10 runs in essence parallel to the center line of the cup and constitutes an interruption of the wall of the cup running from the gap 9 to the open end of the cup 5.

Apart from a small portion located between the gap 9 and the opening 11 of the shield which part serves for fastening the cup to the contact rod 3 no eddy currents can occur in the major part of the shield 5.

Figure 4:
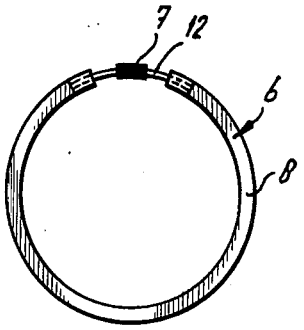
FIG. 4 shows a plan view of a getter element according to the present invention.
Figure 5:
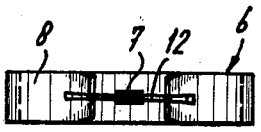
FIG. 5 shows a side elevation of the said getter element.

With reference to FIGS. 4 and 5 there has been shown a preferred embodiment of the getter element 6. This getter element 6 has a circular shape and consists for the major part of its periphery of an almost closed ring 8 made of a good electrically conductive material. In the present case this ring is made of a flat strip. The open ends of the not entirely closed ring 8 are connected to each other by means of a part 12 consisting in the present case of a wire of resistance material. This wire may be pushed into the bores provided from the cross ends in the strip 8 although this wire may also be soldered at its ends to the ring 8.

Onto the part 12 there is applied a layer of getter material 7. Upon generating eddy currents in the ring 8 by means of a high frequency coil 18 positioned outside the envelope 1 of the vacuum switch these eddy currents will be converted into heat in the part 12 by means of which the getter material 7 may finally be evaporated.

By means of such a getter element it is possible to evaporate the getter material at the predetermined location only.

The getter element 6 is now mounted in the vacuum switch in such a manner with respect to the shield 5 that it will be positioned in that part of the shield 5 provided with the second slot in which consequently no eddy currents can occur. Although the shield has thus been made of a metal, the inductive coupling between the circular getter element 6 and the external coil 18 is not impeded.

Furthermore the getter element is positioned within the shield in such a manner that the part 12 including the getter material 7 applied thereon is positioned with respect to the contact rod 3 diametrically opposite to the second slot or gap 10 in the shield. The contact rod 3 keeps therefore the evaporated getter material from emanating through the slot 10. The getter material 7 will therefore deposite mainly in the neighbourhood of this material on the shield 5, i.e. on the right hand inner part of the shield in FIG. 1.

By selecting the length and the type of resistance material for the part 12 in relation with the high frequency coil 18 every desired temperature may be attained very accurately.

In case the getter material is electrically conductive and has a sufficiently high resistance for generating the desired heat the part 12 may be made of a wire or strip of the getter material.

Figure 6:
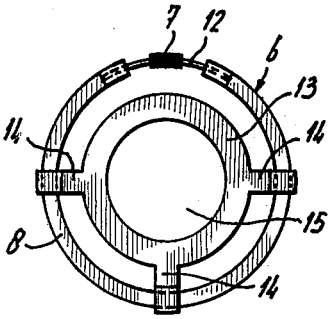
FIG. 6 shows an embodiment of a fastening device for fastening the getter device according to FIGS. 4 and 5.
Figure 7:
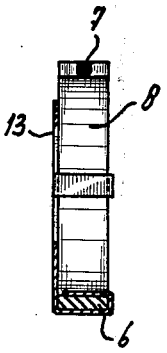
FIG. 7 shows a side elevation of the fastening device according to FIG. 6 including the getter element mounted therein.

With reference to FIGS. 6 and 7 there has been shown an example of a method for fastening the getter element 6 to the contact rod 3. To that effect a fastening device is employed which consists of a circular plate 13 which plate in the center thereof has been provided with an opening 15 by means of which the plate may be fastened to the contact rod 3, while at the circumference there are three radially extending lips displaced with respect to each other over 90° by means of which the getter element 6 may be fastened by bending the lips.

As will be evident from FIG. 1 the contact rod 3 may include a part having a smaller diameter over which the circular plate 13 having an opening 15 may be pushed against the shoulder 19 forming the transmission to the thicker part of the contact rod 3. The circular plate 13 may be pushed upwardly over a further part of the contact rod having again a somewhat smaller diameter in such a manner that it will rest against the second shoulder. The plate 13 and included therewith the getter element may for instance be fixed to the contact rod 3 by soldering.

The invention being thus described it will be obvious that the same is not restricted to the embodiment represented and discussed above but that modifications and variations thereof are also possible without departure from the spirit and scope of the invention.

I claim:

1. A vacuum switch, comprising:

a vacuum-tight envelope having walls of insulating material;

vacuum contacts mounted on current carrying contact rods, which contacts can be moved with respect to one another;

an electrically conducting ring-shaped getter device coaxially supported by one of said contact rods, said getter device comprising a getter element of material which upon evaporation by the heat of a current induced in said ring-shaped getter device may absorb gases optionally present within said envelope, and including a cylindrical metal shield, coaxially supported by said contact rod and located between said getter element and the walls of said envelope, said shield serving as the surface upon which getter material is deposited, said shield including slots for preventing the flow of eddy currents in said shield, in which the getter element emits the getter material by evaporation at a single segment only of said ring-shaped getter device, said segment and the location of the slots in the shield being situated with respect to one another such that the getter material is located between said contact rod and the inner wall of the shield, so that the contact rod prevents the getter material from emanating from said shield.

2. A shield for a vaccum switch as claimed in claim 1, wherein said shield is in the shape of a cylindrical cup having an opening in the bottom by means of which the shield can be mounted on the contact rod with the center line of the cup coinciding with the center line of said rod, said shield including a first gap extending almost entirely along the circumference of the wall of the cup close to the bottom of the cup and parallel thereto but for a short connecting strip by means of which the two parts of the cup separated from each other by said first gap are kept connected to each other, said shield further including a second gap running perpendicularly to said first gap and extending substantially parallel to the axis of the cup through the wall thereof, starting from the first gap at a point diametrically opposite to the connecting strip and extending to the open end of the cup opposite to the cup bottom.

3. A getter element for a vaccum switch as claimed in claim 1, wherein said ring-shaped getter element consists of an electrical conductor shaped as an annularly bent strip, being interrupted at a circumference location by a segment portion consisting of a wire-shaped or otherwise resistance portion, at least partly covered with getter material.

4. A vacuum switch having a getter element as claimed in claim 3, wherein said getter device is connected to the contact rod by means of a circular plate having in its center an opening, and having at its circumference three radially extending lips divided over 90° along said circumference, by means of which lips the getter device can be supported by bending the lip ends around the getter device.

* * * * *